US010279582B2

(12) United States Patent
Schaede

(10) Patent No.: US 10,279,582 B2
(45) Date of Patent: May 7, 2019

(54) COMBINED PRINTING PRESS

(71) Applicant: KBA-NOTASYS SA, Lausanne (CH)

(72) Inventor: Johannes Georg Schaede, Würzburg (DE)

(73) Assignee: KBA-NOTASYS SA, Lausanne 22 (CH)

( * ) Notice: Subject to any disclaimer, the term of this patent is extended or adjusted under 35 U.S.C. 154(b) by 91 days.

(21) Appl. No.: 15/506,085

(22) PCT Filed: Aug. 25, 2015

(86) PCT No.: PCT/IB2015/056431
§ 371 (c)(1),
(2) Date: Feb. 23, 2017

(87) PCT Pub. No.: WO2016/030819
PCT Pub. Date: Mar. 3, 2016

(65) Prior Publication Data

US 2018/0215136 A1 Aug. 2, 2018

(30) Foreign Application Priority Data

Aug. 26, 2014 (EP) ..... 14182349

(51) Int. Cl.
*B41F 11/02* (2006.01)
*B41F 9/00* (2006.01)
(Continued)

(52) U.S. Cl.
CPC ..... *B41F 11/02* (2013.01); *B41F 9/002* (2013.01); *B41F 9/06* (2013.01); *B41F 15/0809* (2013.01);
(Continued)

(58) Field of Classification Search
CPC .. B41F 9/002; B41F 9/06; B41F 11/02; B41F 15/0809; B41F 15/12; B41F 23/0453;
(Continued)

(56) References Cited

U.S. PATENT DOCUMENTS 5,671,671 A 9/1997 Wyssmann et al.
7,047,883 B2 5/2006 Raksha et al.
(Continued)

FOREIGN PATENT DOCUMENTS

CN 101088760 A 12/2007
CN 101480866 A 7/2009
(Continued)

OTHER PUBLICATIONS

International Search Report for PCT/IB2015/056431 dated Dec. 4, 2015, 7 pages.
(Continued)

*Primary Examiner* — Matthew G Marini
*Assistant Examiner* — Marissa Ferguson-Samreth
(74) *Attorney, Agent, or Firm* — Nixon & Vanderhye, P.C.

(57) ABSTRACT

There is described a combined printing press (10; 10*) for the production of security documents, in particular banknotes, comprising a screen printing group (2; 2*) and an intaglio printing group (3) adapted to process substrates in the form of individual sheets or successive portions of a continuous web. The screen printing group (2; 2*) is located upstream of the intaglio printing group (3) and comprises at least one screen printing unit (20; 20*) designed to print a pattern of optically-variable ink onto one side of the substrates, which optically-variable ink contains flakes that can be oriented by means of a magnetic field. The screen printing group (2; 2*) further comprises a magnetic unit (24; 24*) located downstream of the screen printing unit (20; 20*),
(Continued)

which magnetic unit is designed to magnetically induce an optically-variable effect in the pattern of optically-variable ink applied by the screen printing unit (20; 20*). The screen printing group (2; 2*) further comprises at least one drying/curing unit (25, 28; 25*, 28*) designed to dry/cure the pattern of optically-variable ink in which the optically-variable effect has been induced by the magnetic unit (24), prior to transfer of the substrates to the intaglio printing group (3).

15 Claims, 2 Drawing Sheets

(51) Int. Cl.

| | |
|---|---|
| ***B41F 9/06*** | (2006.01) |
| ***B41F 15/08*** | (2006.01) |
| ***B41F 15/12*** | (2006.01) |
| ***B41F 23/04*** | (2006.01) |
| ***B41F 23/08*** | (2006.01) |

(52) U.S. Cl.
CPC ..... *B41F 15/12* (2013.01); *B41F 23/0453* (2013.01); *B41F 23/08* (2013.01); *B41P 2200/40* (2013.01); *B41P 2215/50* (2013.01); *B41P 2217/50* (2013.01)

(58) Field of Classification Search
CPC .. B41F 23/08; B41P 2200/40; B41P 2215/50; B41P 2217/50
See application file for complete search history.

(56) References Cited

U.S. PATENT DOCUMENTS

| | | | | |
|---|---|---|---|---|
| 7,691,468 | B2 | 4/2010 | Benninger et al. | |
| 8,286,551 | B2 | 10/2012 | Gygi | |
| 8,499,687 | B2 | 8/2013 | Gygy et al. | |
| 8,516,960 | B2 | 8/2013 | Bollettin et al. | |
| 8,621,997 | B2 | 1/2014 | Gygi | |
| 8,813,644 | B2 | 8/2014 | Gygi et al. | |
| 9,221,242 | B2 | 12/2015 | Claude et al. | |
| 9,315,011 | B2 | 4/2016 | Kersten et al. | |
| 9,333,739 | B2 | 5/2016 | Scharkus et al. | |
| 9,403,353 | B2 | 8/2016 | Schaede et al. | |
| 9,475,273 | B2 | 10/2016 | Scharkus et al. | |
| 9,931,832 | B2 * | 4/2018 | Schaede | B41F 31/00 |
| 2004/0051297 | A1 | 3/2004 | Raksha et al. | |
| 2006/0150854 | A1 | 7/2006 | Benninger et al. | |
| 2006/0219107 | A1 | 10/2006 | Gygi | |
| 2009/0183644 | A1 | 7/2009 | Bollettin et al. | |
| 2010/0170408 | A1 | 7/2010 | Gygi et al. | |
| 2010/0236432 | A1 | 9/2010 | Foresti et al. | |
| 2010/0242753 | A1 * | 9/2010 | Gygi | B41F 15/12 101/116 |
| 2011/0017081 | A1 | 1/2011 | Gygi | |
| 2012/0312179 | A1 | 12/2012 | Scheade et al. | |
| 2012/0312180 | A1 | 12/2012 | Scheade et al. | |
| 2013/0112095 | A1 | 5/2013 | Schaede et al. | |
| 2013/0183067 | A1 | 7/2013 | Degott et al. | |
| 2013/0213246 | A1 * | 8/2013 | Schaede | B41F 11/02 101/76 |
| 2013/0298791 | A1 | 11/2013 | Gygi et al. | |
| 2014/0150679 | A1 | 6/2014 | Claude et al. | |
| 2014/0196620 | A1 | 7/2014 | Claude et al. | |
| 2014/0338549 | A1 * | 11/2014 | Schaede | B41F 9/002 101/156 |
| 2015/0047520 | A1 | 2/2015 | Kersten et al. | |
| 2015/0107469 | A1 | 4/2015 | Scharkus et al. | |
| 2015/0135977 | A1 | 5/2015 | Kersten et al. | |
| 2015/0151532 | A1 | 6/2015 | Scharkus et al. | |
| 2016/0221324 | A1 | 8/2016 | Kersten et al. | |
| 2017/0190197 | A1 * | 7/2017 | Schaede | B41F 11/02 |
| 2017/0326873 | A1 * | 11/2017 | Booth | B41F 9/021 |

FOREIGN PATENT DOCUMENTS

| | | | | |
|---|---|---|---|---|
| CN | 102712190 A | | 10/2012 | |
| EP | 0 723 864 | | 7/1996 | |
| EP | 1 842 665 | | 10/2007 | |
| EP | 2 338 682 | | 6/2011 | |
| EP | 2388138 | * | 11/2011 | B41F 11/02 |
| EP | 2 4 33 798 | | 3/2012 | |
| EP | 2 698 254 | | 2/2014 | |
| GB | 2512238 | | 9/2014 | |
| JP | 2013-544666 | | 12/2013 | |
| JP | 2014-37095 | | 2/2014 | |
| WO | WO 2004/007095 | | 1/2004 | |
| WO | WO 2005/000585 | | 1/2005 | |
| WO | WO 2005/002866 | | 1/2005 | |
| WO | 2007116353 | * | 10/2007 | B41F 9/1018 |
| WO | WO 2007/116353 | | 10/2007 | |
| WO | WO 2008/102303 | | 8/2008 | |
| WO | WO 2011/077348 | | 6/2011 | |
| WO | WO 2011/077350 | | 6/2011 | |
| WO | WO 2011/077351 | | 6/2011 | |
| WO | WO 2012/038531 | | 3/2012 | |
| WO | WO 2012/160476 | | 11/2012 | |
| WO | WO 2012/160478 | | 11/2012 | |
| WO | 2013132471 | * | 9/2013 | B41F 9/16 |
| WO | WO 2013/132471 | | 9/2013 | |
| WO | WO 2013/153519 | | 10/2013 | |
| WO | WO 2013/160853 | | 10/2013 | |
| WO | WO 2013/160856 | | 10/2013 | |
| WO | WO 2014/037221 | | 3/2014 | |
| WO | 2013166672 | * | 11/2014 | B41F 13/193 |

OTHER PUBLICATIONS

Written Opinion of the ISA for PCT/IB/2015/056431 dated Dec. 4, 2015, 9 pages.

* cited by examiner

COMBINED PRINTING PRESS

This application is the U.S. national phase of International Application No. PCT/IB2015/056431 filed 25 Aug. 2015, which designated the U.S. and claims priority to EP Patent Application No. 14182349.2 filed 26 Aug. 2014, the entire contents of each of which are hereby incorporated by reference.

TECHNICAL FIELD

The present invention generally relates to a combined printing press of the type comprising a screen printing group and an intaglio printing group. The present invention is in particular applicable for the production of security documents, such as banknotes.

SUMMARY OF THE INVENTION

There is described a combined printing press for the production of security documents, in particular banknotes, comprising a screen printing group and an intaglio printing group adapted to process substrates in the form of individual sheets or successive portions of a continuous web. The screen printing group is located upstream of the intaglio printing group and comprises at least one screen printing unit designed to print a pattern of optically-variable ink onto one side of the substrates, which optically-variable ink contains flakes that can be oriented by means of a magnetic field. The screen printing group further comprises a magnetic unit located downstream of the screen printing unit, which magnetic unit is designed to magnetically induce an optically-variable effect in the pattern of optically-variable ink applied by the screen printing unit. The screen printing group further comprises at least one drying/curing unit designed to dry/cure the pattern of optically-variable ink in which the optically-variable effect has been induced by the magnetic unit prior to transfer of the substrates to the intaglio printing group.

Preferably, the magnetic unit includes a rotating magnetic cylinder assembly carrying magnetic-field generating devices on its circumference. In this particular context, it is advantageous to provide at least one drying/curing cooperating directly with the magnetic cylinder assembly, which at least one drying/curing unit is located on a downstream portion of the circumference of the magnetic cylinder assembly, i.e. a portion of the circumference of the magnetic cylinder assembly that is located before and close to the location where the substrates are taken away from the magnetic cylinder assembly. The purpose of this drying/curing unit is to initiate drying/curing of the ink pattern before the substrate are taken away from the magnetic cylinder assembly.

Advantageously, the screen printing group may further include a drying/curing assembly comprising a drying/curing cylinder located downstream of the magnetic unit and cooperating with one or more drying/curing units for drying/curing of the pattern printed on the substrates prior to transfer thereof to the intaglio printing group.

The drying/curing unit(s) may advantageously be UV curing units, in particular UV-LED curing units.

Further advantageous embodiments of the combined printing press are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawing in which.

DETAILED DESCRIPTION OF EMBODIMENTS OF THE INVENTION

The present invention will be described in the particular context of a sheet-fed printing press for the production of security documents, such as banknotes.

Figure 1:
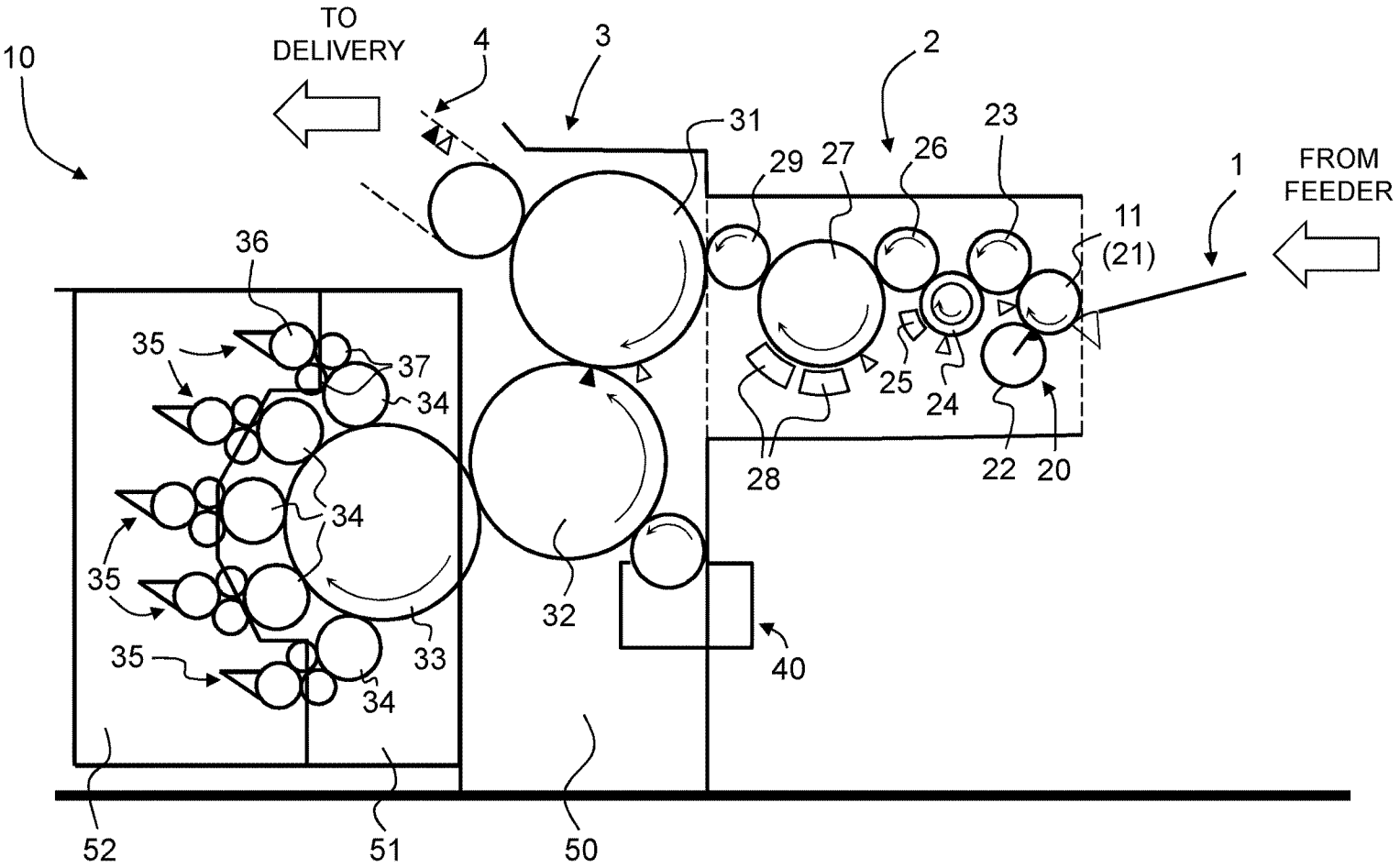
FIG. 1 is a schematic side view of a combined printing press in accordance with one embodiment of the invention.

FIG. 1 is a schematic side view of a combined printing press in accordance with one illustrative embodiment of the invention, which printing press is generally designated by reference numeral 10 and is configured to process individual sheets which are fed in succession through the printing press 10 from a sheet feeder (not shown) located upstream of the relevant printing groups to a delivery (not shown) located downstream of the relevant printing groups.

More precisely, individual sheets are fed in succession from the feeder onto a feeder table 1 as is typical in the art and then via a suitable sheet transfer mechanism (e.g. a swing-gripper system) to a first printing group, namely a screen printing group 2, and then to a second printing group, namely an intaglio printing group 3.

The intaglio printing group 3 consists in this example of an impression cylinder 31 that transports the individual sheets coming from the screen printing group 2 past a printing nip formed between the impression cylinder 31 and a plate cylinder 32 that carries suitably engraved intaglio printing plates, which intaglio printing plates are inked by an inking system 33-37 and wiped by a wiping system 40.

An intaglio printing group 3 of the type shown in FIG. 1 (or FIG. 2) is known as such in the art, for instance from International (PCT) Publications Nos. WO 2011/077348 A1, WO 2011/077350 A1, WO 2011/077351 A1, WO 2013/153519 A2, WO 2013/160853 A2 and WO 2013/160856 A2, which publications are incorporated herein by reference in their entirety.

In the illustrated example, the inking system 33-37 is an indirect inking system comprising an ink-collecting (or "Orlof") cylinder 33 that collects inks transferred by a plurality of chablon (or colour-selector) cylinders 34 which are inked by a corresponding plurality of inking devices 35 (five in this example). Each chablon cylinder 34 carries a suitable chablon plate corresponding to the portion of the intaglio printing plates to be inked. Each inking device 35 typically includes an ink fountain with an ink fountain roller 36 that inks a corresponding one of the chablon cylinders 34 via a pair of inking rollers 37. The resulting multicolour pattern of inks collected by the ink-collecting cylinder 33 is transferred onto the intaglio printing plates carried by the plate cylinder 32 and then wiped by a suitable wiping system 40, such as a wiping system of the type comprising a rotating wiping roller (see e.g. WO 2007/116353 A1, WO 2012/160476 A1, WO 2012/160478 A1 and WO 2013/132471 A1).

The thus-wiped intaglio printing plates are then brought into contact with the sheets (namely with the underside thereof) at the printing nip between the impression cylinder 31 and the plate cylinder 32 where intaglio printing occurs at high pressure, thereby imparting a printed pattern having a characteristic relief and tactility.

Once printed in the intaglio printing group 3, the sheets are taken away from the impression cylinder 31 by a suitable sheet delivery system 4 for further transport to the delivery.

In the example shown in FIG. 1 (and FIG. 2), the impression cylinder 31, plate cylinder 32 and wiping system 40 are advantageously supported in a stationary machine frame 50, while the inking system 33-37 is supported in one, preferably two mobile carriages 51, 52 that can be retracted away from the stationary machine frame 50. In the illustrated example, the ink-collecting cylinder 33 and chablon cylinder 34 are supported in a first mobile carriage 51, while the inking devices 35 (including the ink fountain roller 36 and the inking rollers 37) are supported in a second mobile carriage 52 (see e.g. WO 2011/077348 A1, WO 2011/077350 A1 and WO 2011/077351 A1).

Prior to being processed by the intaglio printing group 3, the sheets are first processed by the screen printing group 2 that will now be described in greater detail.

In the example of FIG. 1, the screen printing group 2 is advantageously designed to print the same side (i.e. the underside) of the sheets as the subsequent intaglio printing group 3. The screen printing group 2 includes at least one screen printing unit 20 including a screen (or stencil) cylinder 22 that cooperates with an impression cylinder 21. In the illustrated example, this impression cylinder 21 also acts as sheet transfer cylinder or drum 11 receiving the individual sheets fed from the feeder table 1. Ink is fed from the interior of the screen cylinder 22 and applied through the screen under the action of a squeegee in a manner known as such in the art (see e.g. EP 0 723 864 A1).

In accordance with the invention, the screen printing unit 20 is advantageously designed to apply a pattern of optically-variable ink, which optically-variable ink contains flakes that can be oriented by means of a magnetic field. Such ink may be a so-called Optically Variable Magnetic Ink (or OVMI®) as available from SICPA SA.

Once printed by the screen printing unit 20, the sheets are fed to another sheet transfer cylinder or drum 23 before reaching a magnetic unit 24 designed to magnetically induce an optically-variable effect in the pattern of optically-variable ink applied by the screen printing unit 20 prior to drying/curing of the optically-variable ink. This technology is known as the Spark® technology (OVMI® and Spark® being registered trademarks of SICPA HOLDING SA).

The purpose of the magnetic unit 24 is to induce a desired optically-variable effect in the pattern of optically-variable ink by subjecting the relevant portion of the pattern to a magnetic field exhibiting a suitable distribution of the magnetic field lines as generally described in e.g. International (PCT) Publications Nos. WO 2004/007095 A2, WO 2005/000585 A1 and WO 2005/002866 A1.

The magnetic unit 24 preferably includes a rotating magnetic cylinder assembly 24 carrying magnetic-field generating devices on its circumference (as for instance taught by International (PCT) Publications Nos. WO 2005/000585 A1, WO 2008/102303 A2, WO 2012/038531 A1, WO 2014/037221 A1 and European Patent Publication No. EP 2 433 798 A1). Preferably a drying/curing unit 25 (advantageously a UV curing unit) is located on a downstream portion of the circumference of the magnetic cylinder assembly 24, i.e. a portion of the circumference of the magnetic cylinder assembly 24 that is located before and close to the location where the sheet is taken away from the magnetic cylinder assembly 24. The purpose of this drying/curing unit 25 is to initiate drying/curing of the ink pattern before the sheet is taken away from the magnetic cylinder assembly 24.

It will be understood that the magnetic cylinder assembly 24 is brought in contact with the upper side of the sheets in the example of FIG. 1, i.e. the side that is opposite to the side where the pattern of ink has been printed by the screen printing unit 20. On the other hand, the drying/curing unit 25 is located below the path of the sheets so as to dry/cure the ink printed on the underside of the sheets.

The sheets are then transferred away from the magnetic cylinder assembly 24 to a sheet transfer cylinder or drum 26. Preferably, the sheets are transferred from the sheet transfer cylinder or drum 26 to a drying/curing cylinder 27 for further drying/curing of the pattern printed on the sheets prior to transfer thereof to the intaglio printing group 3. One or more drying/curing units 28 (preferably UV curing units) are distributed about the circumference of the drying/curing cylinder 27. This ensures proper drying/curing of the ink pattern before transfer of the sheets to the intaglio printing group 3.

In the example of FIG. 1, the sheets are transferred from the drying/curing cylinder 27 to the impression cylinder 31 of the intaglio printing group 3 via a suitable sheet transfer cylinder or drum 29.

Figure 2:
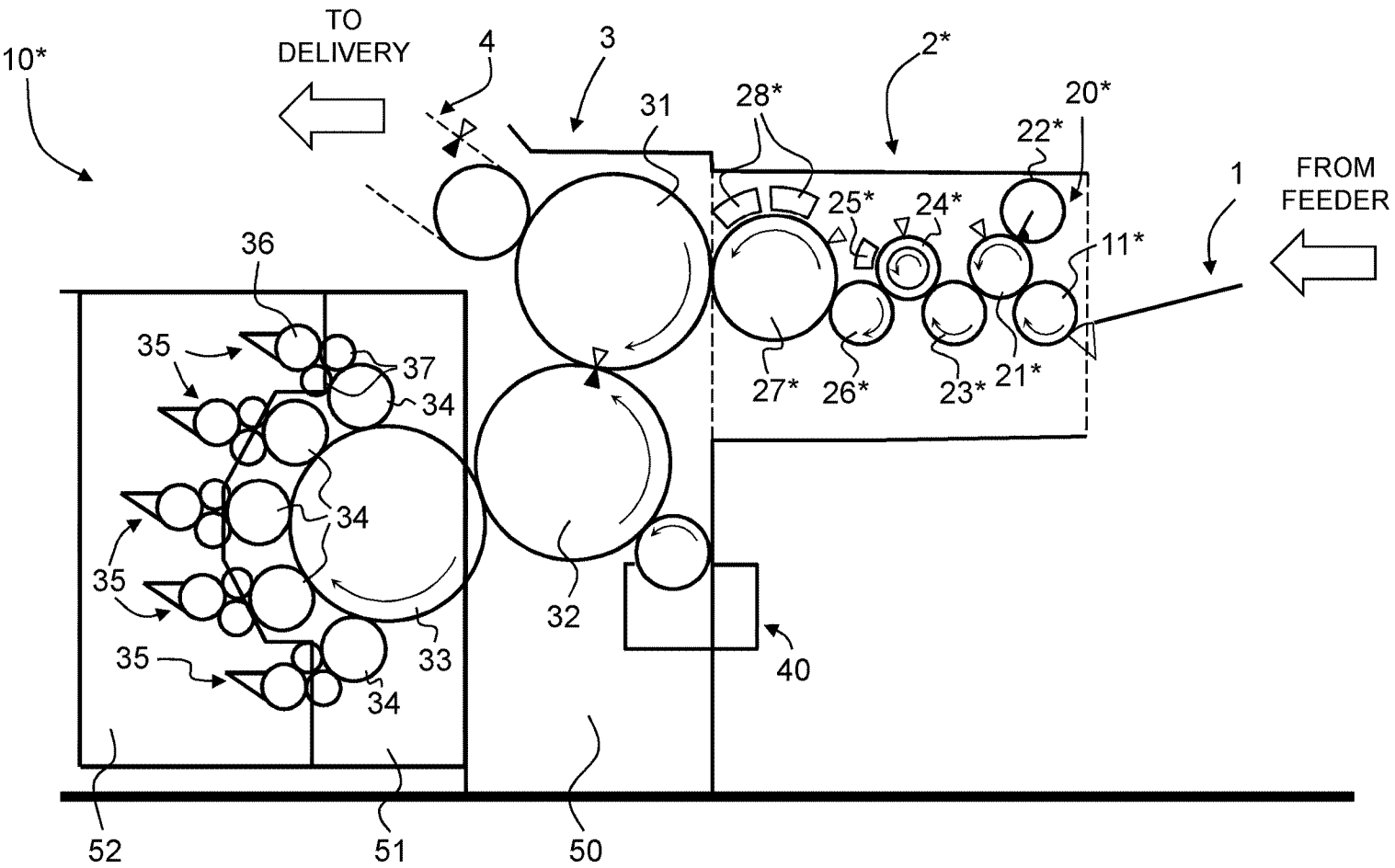
FIG. 2 is a schematic side view of a combined printing press in accordance with another embodiment of the invention.

FIG. 2 illustrates a schematic side view of a combined printing press in accordance with another illustrative embodiment of the invention, which printing press is generally designated by reference numeral 10* and is again configured to process individual sheets which are fed in succession through the printing press 10* from a sheet feeder (not shown) located upstream of the relevant printing groups to a delivery (not shown) located downstream of the relevant printing groups.

More precisely, like in the example of FIG. 1, individual sheets are fed in succession from the feeder onto the feeder table 1 and then via a suitable sheet transfer mechanism (e.g. a swing-gripper system) to a first printing group, namely a screen printing group 2*, and then to a second printing group, namely an intaglio printing group 3.

The intaglio printing group 3 of FIG. 2 is identical to that of FIG. 1 and will not therefore be described again.

In the example of FIG. 2, the screen printing group 2* is advantageously designed to print the other side of the sheets, i.e. the side opposite to the side of the sheets that is printed by the intaglio printing group 3. The screen printing group 2* includes at least one screen printing unit 20* including a screen (or stencil) cylinder 22* that cooperates with an impression cylinder 21*. In the illustrated example, this impression cylinder 21* receives the sheets transferred from the sheet transfer cylinder or drum 11*. Ink is likewise fed from the interior of the screen cylinder 22* and applied through the screen under the action of a squeegee in a manner known as such in the art, like in FIG. 1, with the difference that the screen cylinder 22* is located above the path of the sheets in the example of FIG. 2.

In accordance with the invention, the screen printing unit 20* is likewise advantageously designed to apply a pattern of optically-variable ink that contains flakes that can be oriented by means of a magnetic field. Such ink may again be an Optically Variable Magnetic Ink (or OVMI®). Once printed by the screen printing unit 20*, the sheets are fed to another sheet transfer cylinder or drum 23* before reaching a magnetic unit 24* designed to magnetically induce an optically-variable effect in the pattern of optically-variable ink applied by the screen printing unit 20* prior to drying/curing of the optically-variable ink. Like in the example of FIG. 1, the magnetic unit 24* preferably includes a rotating magnetic cylinder assembly 24* carrying magnetic-field generating devices on its circumference. A drying/curing unit 25* (preferably a UV curing unit) is likewise preferably located on a downstream portion of the circumference of the rotating cylinder assembly 24*, i.e. a portion of the circumference of the magnetic cylinder assembly 24* that is located before and close to the location where the sheet is taken away from the magnetic cylinder assembly 24*. The function and purpose of the magnetic unit 24* and drying/curing unit 25* are similar to that of the magnetic unit 24 and drying/curing unit 25 of FIG. 1, with the difference that the magnetic cylinder assembly 24* is located below the path of the sheets so as to cooperate with the underside of the sheets and the drying/curing unit 25* is located above the path of the sheets so as to dry/cure the ink printed on the upper side of the sheets.

The sheets are then transferred away from the magnetic cylinder assembly 24* to a sheet transfer cylinder or drum 26*. Preferably, the sheets are transferred from the sheet transfer cylinder or drum 26* to a drying/curing cylinder 27* for further drying/curing of the pattern printed on the sheets prior to transfer thereof to the intaglio printing group 3. One or more drying/curing unit 28* (preferably UV curing units) are distributed about the circumference of the drying/curing cylinder 27*. This again ensures proper drying/curing of the ink pattern before transfer of the sheets to the intaglio printing group 3.

In the example of FIG. 2, the sheets can be transferred directly from the drying/curing cylinder 27* to the impression cylinder 31 of the intaglio printing group 3.

In the examples of FIGS. 1 and 2, the sheet transfer cylinder or drums 23, 26, resp. 23*, 26* can advantageously be designed as sheet transfer drums designed to prevent or minimize contact with the printed side of the sheets.

Preferably, the screen printing group 2, resp. 2* and intaglio printing group 3 are designed as modular printing groups, i.e. printing groups that can easily be disconnected from one another.

The drying/curing units 25, 28, resp. 25*, 28* may advantageously be LED units, in particular UV-LED curing units.

Various modifications and/or improvements may be made to the above-described embodiments. In particular, while the embodiments discussed above relate to sheet-fed printing presses, the invention is also applicable to web-fed printing presses. In addition, the screen printing group may comprise more than one screen printing unit and magnetic unit.

LIST OF REFERENCE NUMERALS USED THEREIN

10 combined printing press (first embodiment of FIG. 1)
10* combined printing press (second embodiment of FIG. 2)
1 feeder table
2 screen printing group (first embodiment of FIG. 1)
2* screen printing group (second embodiment of FIG. 2)
3 intaglio printing group
4 sheet delivery system (e.g. chain gripper system)
11 sheet transfer cylinder receiving sheets fed from feeder table 1 (FIG. 1)
11* sheet transfer cylinder receiving sheets fed from feeder table 1 (FIG. 2)
20 screen printing unit of screen printing group 2
21 impression cylinder of screen printing unit 20 (one-segment cylinder) also acts as sheet transfer cylinder 11
22 screen (stencil) cylinder of screen printing unit 20
23 sheet transfer cylinder or drum
24 magnetic cylinder assembly (magnetic unit)
25 drying/curing unit (e.g. UV curing unit, preferably UV-LED curing unit) cooperating with magnetic cylinder assembly 24
26 sheet transfer cylinder or drum
27 drying/curing cylinder
28 drying/curing units (e.g. UV curing unit, preferably UV-LED curing unit) cooperating with drying/curing cylinder 27
29 sheet transfer cylinder or drum
20* screen printing unit of screen printing group 2*
21* impression cylinder of screen printing unit 20* (one-segment cylinder)
22* screen (stencil) cylinder of screen printing unit 20*
23* sheet transfer cylinder or drum
24* magnetic cylinder assembly (magnetic unit)
25* drying/curing unit (e.g. UV curing unit, preferably UV-LED curing unit) cooperating with magnetic cylinder assembly 24*
26* sheet transfer cylinder or drum
27* drying/curing cylinder
28* drying/curing units (e.g. UV curing unit, preferably UV-LED curing unit) cooperating with drying/curing cylinder 27
31 impression cylinder of intaglio printing group 3 (three-segment cylinder)
32 plate cylinder of intaglio printing group 3 (three-segment cylinder)
33 ink-collecting ("Orlof") cylinder inking the intaglio printing plates carried by the plate cylinder 32 (three-segment cylinder)
34 chablon (colour-selector) cylinders cooperating with ink-collecting cylinder 33
35 inking devices inking chablon cylinder 34
36 ink fountain roller
37 pair of inking roller transferring ink from the ink fountain roller 36 to the chablon cylinder 34
40 ink wiping system cooperating with plate cylinder 32
50 stationary machine frame supporting impression cylinder 31, plate cylinder 32 and in wiping system 40
51 (first) mobile carriage supporting ink collecting cylinder 33 and chablon cylinders 34
52 (second) mobile carriage supporting inking devices 35

The invention claimed is:

1. A combined printing press for the production of security documents, in particular banknotes, comprising a screen printing group, and an intaglio printing group adapted to process substrates in the form of individual sheets or successive portions of a continuous web, wherein the screen printing group is located upstream of the intaglio printing group and comprises at least one screen printing unit designed to print a pattern of optically-variable ink onto one side of the substrates, which optically-variable ink contains flakes that are orientable by means of a magnetic field, wherein the screen printing group further comprises a magnetic unit located downstream of the screen printing unit, which magnetic unit is designed to magnetically induce an optically-variable effect in the pattern of optically-variable ink applied by the screen printing unit, wherein the screen printing group further comprises at least one drying/curing unit designed to dry/cure the pattern of optically-variable ink in which the optically-variable effect has been induced by the magnetic unit prior to transfer of the substrates to the intaglio printing group, wherein the screen printing group comprises a drying/curing assembly located downstream of the magnetic unit and designed to subject the substrates to a drying/curing operation prior to transfer of the substrates to the intaglio printing group, which drying/curing assembly includes a drying/curing cylinder and one or more drying/curing units positioned about part of the circumference of the drying/curing cylinder, and wherein the screen printing group comprises a first drying/curing unit cooperating directly with the magnetic unit.

2. The combined printing press as defined in claim 1, wherein the magnetic unit includes a rotating magnetic cylinder assembly carrying magnetic-field generating devices on its circumference and wherein the first drying/curing unit cooperates with a portion of the circumference of the rotating magnetic cylinder assembly.

3. The combined printing press as defined in claim 2, wherein the first drying/curing unit is positioned on a downstream portion of the circumference of the rotating magnetic cylinder assembly that is located before and close to a location where the substrates are taken away from the magnetic cylinder assembly.

4. The combined printing press as defined in claim 1, wherein the first drying/curing unit is a UV-curing unit.

5. The combined printing press as defined in claim 4, wherein the first drying/curing unit is a UV-LED curing unit.

6. The combined printing press as defined in claim 1, wherein the one or more drying/curing units of the drying/curing assembly are UV-curing units.

7. The combined printing press as defined in claim 6, wherein the one or more drying/curing units of the drying/curing assembly are UV-LED curing units.

8. The combined printing press as defined in claim 1, wherein the screen printing group further comprises a transfer cylinder or drum that is interposed between the magnetic unit and the drying/curing assembly.

9. The combined printing press as defined in claim 8, wherein the transfer cylinder or drum is configured to prevent contact with the printed side of the substrates.

10. The combined printing press as defined in claim 1, wherein the screen printing group further comprises a transfer cylinder or drum that is interposed between the screen printing unit and the magnetic unit.

11. The combined printing press as defined in claim 10, wherein the transfer cylinder or drum is configured to prevent contact with the printed side of the substrates.

12. The combined printing press as defined in claim 1, wherein the screen printing group and the intaglio printing group are both designed to print a same side of the substrates.

13. The combined printing press as defined in claim 1, wherein the screen printing group and the intaglio printing group are designed to print opposite sides of the substrates.

14. The combined printing press as defined in claim 1, wherein the intaglio printing group comprises an impression cylinder, a plate cylinder cooperating with the impression cylinder, an inking system inking the plate cylinder and a wiping system wiping the inked surface of the plate cylinder.

15. The combined printing press as defined in claim 14, wherein the inking system is an indirect inking system comprising an ink-collecting cylinder collecting inks from a plurality of chablon cylinders, which ink-collecting cylinder cooperates with the plate cylinder.

* * * * *